United States Patent [19]

Birkle et al.

[11] 4,144,360

[45] Mar. 13, 1979

[54] METHOD FOR THE CURRENTLESS CATALYTIC PRECIPITATION OF ALUMINUM

[75] Inventors: Siegfried Birkle, Höchstadt; Richard Dötzer, Nüremberg; Eva Rissel, Forchheim, all of Fed. Rep. of Germany

[73] Assignee: Siemens Aktiengesellschaft, Munich, Fed. Rep. of Germany

[21] Appl. No.: 820,700

[22] Filed: Aug. 1, 1977

[30] Foreign Application Priority Data

Aug. 9, 1976 [DE] Fed. Rep. of Germany ..... 2635798

[51] Int. Cl.[2] ..... C23C 3/02

[52] U.S. Cl. ..... 427/123; 427/58; 427/304; 427/352; 427/436; 106/1.11; 106/1.25

[58] Field of Search ..... 106/1.11, 1.25; 427/304, 123, 436, 58, 352; 134/42

[56] References Cited

U.S. PATENT DOCUMENTS

| | | | |
|---|---|---|---|
| 3,537,878 | 11/1970 | Baudrand | 106/1.11 |
| 3,639,139 | 2/1972 | Schneggenburger | 106/1.25 |
| 3,963,841 | 6/1976 | Anschel | 106/1.11 |

*Primary Examiner*—Michael F. Esposito

*Attorney, Agent, or Firm*—Kenyon & Kenyon, Reilly, Carr & Chapin

[57] ABSTRACT

The invention relates to a method for the currentless catalytic precipitation of aluminum. The surface of insulating and conductive materials (substrates) to be aluminized is (1) catalyzed, while a film-forming moisture-insensitive layer is developed, with a compound active at the boundary surfaces, by a brief immersion in a dilute solution of (a) a modified ester or acylate of titanium, zirconium or vanadium, substituted at the metal atom with short- and long-chain organic radicals or (b), a chloride of the transition metals of the IV and V secondary group of the periodic system of the elements and a water-containing metal soap of a polyvalent metal, preferably aluminum soaps; (2) is intensively rinsed with aprotic solvents, preferably having a boiling point of over 100° C.; and (3) is immersed in a 1 to 4% solution of trialkylaminalanes in a solvent mixture of aromatic and highly viscous aliphatic compounds. A homogeneous and strongly adhering aluminum coating is thereby obtained.

Insulating and conductive materials and components, e.g., electronic components and reflectors can in this manner be homogeneously coated with strongly adherent aluminum.

19 Claims, No Drawings

METHOD FOR THE CURRENTLESS CATALYTIC PRECIPITATION OF ALUMINUM

BACKGROUND OF THE INVENTION

The present invention relates to a method for the currentless catalytic precipitation of the aluminum of aprotic alan complex baths on substrate surfaces.

It is known that titanium tetrachloride causes considerable decomposition of aluminum-hydrogen compounds. According to the method described in the German Auslegeschrift No. 1,621,227, aluminum can be precipitated, in the presence of a decomposition catalyst, for example, one or several compounds of metals of the group IVB and VB of the periodic system of the elements, from an aluminum hydride compound such as complex alkali-, earth alkali- or magnesium-aluminum hydrides. It has been found, however, that such a catalyst does not adhere firmly on the substrate to be aluminized. Hence, the catalyst separates in the aluminizing bath from the substrate and results in the substrate being coated unevenly. Often the catalytic layer is too thick, and instead of the substrate being aluminized, the catalyst is separated in the aluminizing bath from the substrate and the immersion aluminizing bath is itself decomposed. Therefore, a technically usable aluminizing method cannot be realized in practice utilizing such a process since certain prerequisites regarding the activation of substrates and the aluminizing per se are lacking. Using the catalysts given in the German Auslegeschrift No. 1,621,227, the substrate to be aluminized cannot be coated with a firmly adhering catalytic film, a condition which has been found to be required for the precipitation of aluminum on the surface of the substrate. The materials named as catalysts in the German Auslegeschrift are not bonded to the substrate adsorptively, and, hence, they separate off in the aluminizing bath.

SUMMARY OF THE INVENTION

It is accordingly an object of this invention to prepare firmly adhering, dense and homogeneous aluminum coatings on insulating and conductive materials by currentless precipitation of aluminum in the liquid phase in the presence of boundary surface-active catalysts, in which the above-described disadvantages are avoided, and in which the aluminizing bath used is not thermally decomposed even at temperatures of about 100° C.

According to the invention, this and other objects are attained by the provision of a process for the currentless precipitation of aluminum wherein (1) the surface of a substrate to be aluminized is activated in the liquid phase by means of a dilute solution of a boundary surface-active catalyst in a catalytic bath; (2) the activated substrate is thereafter intensively washed in a rinsing bath in aprotic solvents, preferably such solvents having a boiling point above about 100° C.; and (3) aluminum is subsequently applied by immersion of the activated substrate in a solution of trialkylaminalane in a solvent mixture of aromatics and high-viscosity aliphatics in an aluminizing bath. Preferably, catalytic and rinsing baths containing high-boiling solvents are utilized.

The boundary surface-active decomposition catalysts utilized in accordance with this invention are only slightly moisture-sensitive and have great catalytic effectiveness in the decomposition of alanes at low temperatures. They ensure uniform activation of the substrate surface such that the aluminum is precipitated simultaneously on the entire substrate surface. The catalysts are drawn up from the liquid phase to firmly adhere onto the substrate, it being an advantage in many cases that they are drawn up on the substrate as a film. Utilization of the boundary surface-active decomposition catalysts according to this invention results in a homogeneous aluminum coating being obtained.

As regards the substrate to be aluminized, suitable insulating materials are, for example, glass, aluminum oxide ceramics, hydrophobic teflon, silicon, silicon dioxide, and beryllium oxide ceramics, while suitable conductive materials are, for example, copper, nickel and steel.

DETAILED DESCRIPTION OF THE INVENTION

According to one embodiment of the invention, the boundary surface-active catalysts may contain dilute solutions of modified esters or acylates of titanium, zirconium and vanadium, which are substituted at the metal atom by short- and long-chain organic radicals. Particularly well suited are esters and acylates of the above-noted transition metals having short-chain alkyl groups such as isopropyl and butyl. Long-chain alkyl radicals having at least 8, and preferably 16 to 18, carbon atoms constitute a protective component against moisture sensitivity, the protective action being based on an increase of the hydrophobic properties of the transition metal ester or acylate.

The mixed esters of the transition metals of titanium, zirconium and vanadium can be prepared by addition of the desired amount of the higher alcohol to a short-chain ester such that partial substitution of the lower alcohol by the higher one takes place. It is a particular advantage of the method according to this invention that the long-chain alkyl radicals of the modified esters promote the formation of a film which enables the decomposition catalysts to be pulled up on the substrate as a firmly adhering and uniform transparent film. The same is also true for the acylates or the partially acylated esters. It is a significant advantage of the method according to this invention that the degree of condensation of the esters and acylates has no dominant effect on their catalytic effectiveness.

Although the use of the pure esters for activating is possible in principle, the use of the mentioned catalysts has nevertheless been found as particularly advantageous in high dilution, i.e., in concentrations in the range of preferably $1 \times 10^{-4}$ to 2% by weight.

The polarity of the solvent can also exert a significant influence on the boundary surface activity of the decomposition catalysts and, thereby, on the uniformity of the aluminum plating. Non-polar solvents, preferably aliphatic hydrocarbons having 5 to 15 carbon-atoms have been found to be particularly well suited.

For aluminizing glass, metal alkyls of the above-mentioned transition metals have feen found to be particularly well suited. In other cases the metal acylates or acylated metal alkyls of the above-mentioned transition metals stand out as particularly advantageous.

A very special advantage of the catalysts used in accordance with this invention is the fact that there are no halogen ions or alkali metal ions which might have a negative effect on the electrical properties of p-n junctions. The catalysts and process of the present invention are, therefore, particularly well suited for aluminizing electronic components.

According to another advantageous embodiment of this invention, a firmly adhering, film-forming and relatively moisture-insensitive layer having an activating effect can be generated on the surface of the substrate material to be aluminized by immersion of the substrate in a solution of chlorides of the transition metals of the IV and V secondary groups of the periodic system of the elements, preferably titanium tetrachloride, and water-containing metal soaps of polyvalent metals, preferably aluminum soaps. This method of activation is particularly advantageous in the case of substrates which are soluble or swellable in hydrocarbons and therefore cannot be sensitized with the earlier-mentioned activation method.

In accordance with one preferred embodiment, an ether solution of water-containing aluminum tripalmitate and titanium tetrachloride is used for activating the substrate. Other suitable metal soaps are, for example, water-containing aluminum tristearate, mono- or distearic acid derivatives and other water-containing soaps.

The decomposition catalysts and the soaps may be present in solution in varying ratios. However, the content of decomposition catalyst in the solution is always higher than that of the soap molecule. The solutions contain between about $1 \times 10^{-5}$ to 1 mol, and preferably 0.001 to 0.006 mol, of the metal (e.g., aluminum) soap per liter of solution, the amount of decomposition catalyst being thereby chosen accordingly. The ratio of the metal soap to the decomposition catalyst is preferably in the range between about 0.0005 to 0.005. The water content of the catalyst system is between about $1 \times 10^{-6}$ and 3% by weight. It is surprising that such combinations are boundary surface-active catalysts for the precipitation of aluminum from alane complexes. The catalysts pull up onto the substrate uniformly from solutions as transparent, extremely thin films.

In the process step following activation of the substrate, i.e., the intensive washing of the activated substrate in aprotic solvents, the catalyst particles loosely adhering to the substrate are removed. In this manner the aluminizing bath is not decomposed when the activated substrate is immersed therein. This intensive washing process also makes possible subsequent homogeneous and firmly adhering aluminization by immersion, particularly as to those substrates having depressions. On the other hand, the activity of the catalysts is not degraded as regards the decomposition of aluminum-hydrogen compounds by this intensive washing process in organic solvents.

For carrying out the method according to this invention, the activated substrates are intensively rinsed in high-boiling solvents, preferably such solvents having a boiling point above about 100° C. After the rinsing, a hydrophobic moisture film remains on the activated substrate surface which additionally protects the catalyst against moisture.

According to the invention, the activated and intensively rinsed substrate is subsequently immersed in an aluminizing bath having a temperature of from about 40° to 100° C., and preferably, from about 60° to 80° C. In the process, a dense, homogeneous and firmly adhering aluminum layer is deposited on the substrate within 1 to 2 minutes.

According to this invention, the aluminizing bath contains trialkylaminalane in a solvent mixture of aromatics and high-viscosity aliphatics. The bath is easy to handle and not flammable. A 0.2 to 10%, and preferably 1 to 4%, alane bath solution is used, preferably with a volume ratio of aromatics to aliphatics in the range of 4:1 to 3:7.

In accordance with the method of this invention, insulating and conductive materials and components, for example, electrical components and reflectors, which may be subjected to special pre-treatment depending upon the material, can be aluminized homogeneously with firm adherence.

The invention will be explained in further detail by the following examples.

EXAMPLE 1

Different substrates are immersed at room temperature for 1 minute in a catalytic bath which contains, per liter of diethyl ether, 0.045 mol $TiCl_4$ and 0.0022 mol of water-containing aluminum tristearate. The aluminum stearate contains 0.5% water. The activated substrate is removed from the catalyst solution (which has a deep red-brown color), and is intensively rinsed for ½ minute in diethyl ether. The substrate so treated is lowered for 1 minute into an immersion bath at 80° C. which contains 2 g trimethyl aminalane dissolved in 88 ml of a solvent mixture of toluene and paraffin oil (DAB 7) in a volume ratio of 30:70. After removal from the aluminizing bath, the substrate is uniformly coated with a firmly adhering coating.

In the following Table, a number of the substrates utilized and the appearance of the coating obtained are summarized:

| Substrate | Appearance of the Aluminum Coating |
|---|---|
| Glass | mirror-like |
| Copper (polished) | mirror-like |
| Nickel | mirror-like |
| Sheet steel (sandblasted) | silver-bright, dull |
| $Al_2O_3$ ceramics | mirror-like |
| BeO sintered ceramics | silver-bright, dull |
| Teflon (made hydrophilic) | silver-bright, dull |

EXAMPLE 2

In a manner similar to Example 1, a glass substrate is immersed in a 0.045 m catalyst solution of $TiCl_4$ in diethyl ether, to which 0.0022 mols of aluminum hydroxystearate were added. After intensive rinsing of the activated substrate in ether at room temperature, mirror-like, firmly adhering aluminum is uniformly precipitated on the substrate surface in the above-described aluminizing bath of Example 1.

EXAMPLE 3

Similarly results are also obtained if a copper sheet is immersed in a 0.045 m catalyst solution of $TiCl_4$ in butyl ether, in which additionally 0.001 mols aluminum oleate were dissolved.

For comparison with the above-mentioned examples, a glass substrate was catalyzed in a 0.045 m solution of $TiCl_4$ in diethyl ether without the addition of one of the above-mentioned aluminum soaps. After intensive rinsing of the activated substrate, scarcely any aluminum is precipitated on the substrate surface in the trimethylaminalane bath. Only in some spots can extremely thin, non-coherent aluminum be found.

If one carries out the same aluminizing test without rinsing the catalyzed substrate, the catalyst which adheres loosely to the surface of the substrate quickly separates in the aluminizing bath. Instead of an aluminum coating on the substrate, one obtains a rapid decomposition of the alane bath, while grey, powdered aluminum is precipitated. The same phenomenon also occurs in other alane baths.

EXAMPLE 4

A silicon wafer made hydrophilic is immersed in a 0.045 m catalyst solution of $TiCl_4$ in a solvent mixture of 60% by volume diethyl ether and 40% by volume hexane, to which 0.002 mol aluminum tristearate are added. After intensive rinsing of the activated wafer in a solvent mixture of 50% by volume ether and 50% by volume hexane, the silicon so treated is uniformly coated with mirror-like aluminun in the above-mentioned aluminizing bath of Example 1. It is of special interest that the chemically precipitated aluminum adheres to silicon considerably better than aluminum which is vapor-deposited at the same substrate temperature.

EXAMPLE 5

The procedure described in Example 4 was repeated using iron tripalmitate as the catalytic component is place of aluminum tristearate.

The shiny aluminum coating obtained adheres well to the substrate.

EXAMPLE 6

An anodically oxidized aluminum sheet is immersed in a 0.045 m solution of $TiCl_4$ in diethyl ether which contains additionally 0.001 mol stearic acid. The activated substrate is rinsed intensively in ether. After immersion in an aluminizing bath as in Example 1, it is uniformly coated with aluminum.

EXAMPLE 7

The procedure described in Example 6 is repeated using palmitinic acid in place of stearic acid as the catalytic additive.

EXAMPLE 8

The procedure described in Example 6 is repeated using oleic acid in place of stearic acid as the catalytic additive.

EXAMPLE 9

After first being degreased in chromic sulfuric acid, rinsed in water and dried, a glass substrate is immersed in a catalyst solution which contains 0.0045 mol $TiCl_4$ and 0.001 mol of the mono-aluminum salt of the tetradecandicarbonic acid in one liter of a solvent mixture of 60% by volume ether and 40% by volume hexane. After intensive rinsing of the activated substrate in ether, the substrate is immersed for one minute in the above-described aluminizing bath at 80° C. After removal from the aluminizing bath, the substrate is coated uniformly with a firmly adhering aluminum coating.

EXAMPLE 10

A teflon strip which was first treated with EX T-9, is immersed, after intensive rinsing with THF and water and subsequent drying, in a catalyst bath which contains 0.0005 mol $TiCl_4$ and 0.0005 mol 12-ethoxy aluminum tristearate dissolved in one liter of hexane. The activated material is intensively rinsed in hexane and subsequently immersed in the above-described alumininizing bath. The aluminum is unformly precipitated on the substrate surface.

EXAMPLE 11

An oxide-free copper strip is immersed for 30 seconds in a $2 \times 10^{-5}$ mol catalyst solution of ethyl titanate in hexane of 20 to 25° C. and thereupon is rinsed for about the same time in the same solvent. Upon contact with the immersion aluminizing bath described in Example 1 , the substrate is uniformly coated with an extremely firmly adhering aluminum coating.

The same results are also obtained if the corresponding compounds of zirconium or vanadium are used instead of the ethyl titanate.

EXAMPLE 12

In the same manner as in Example 11, a silicon dioxide wafer is activated and aluminized, except for the difference that the solvent of the catalyst and the rinsing bath is n-octane. After the individual treatment steps, the relatively non-volatile solvent then remains as a liquid film on the substrate and protects the underlying catalyst layer from moisture.

The same protective effect is also obtained if 1 to 2 drops of high-viscosity paraffin oil (DAB 7) are added to the catalyst bath and the rinsing bath which contain a lower-boiling solvent.

For comparison with Examples 11 and 12, stearyl titanate and octyl titanate are used as the catalytic substances. Although these compounds decompose alane compounds catalytically, they are not suited as catalysts because of their boundary surface inactivity. If one rinses a substrate after immersion in the catalyst bath in an organic solvent, the catalyst dissolves completely in the rinsing bath. If one omits the rinsing and immerses the substrate coated with catalyst directly in the immersion aluminizing bath, the catalyst likewise separates from the substrate and immediately initiates the complete self-decomposition of the aluminizing substance in the bath.

EXAMPLE 13

In the same manner as in Example 11, a profiled glass part with depressions is activated in a $1 \times 10^{-5}$ m catalyst solution of stearylethyl titanate in octane. After intensive rinsing of the substrate in octane, aluminum precipitates, firmly adhering, on the substrate surface in the aluminizing bath.

Introducing the hydrophobic stearyl radical instead of an ethyl group results in the catalyst being less sensitive to moisture.

If the activated test piece with its depressions is placed directly in the immersion aluminizing bath, the catalyst solution, which is present in excess in the depressions, runs into the aluminizing bath and initiates the self-decomposition of the trimethyl aminalane. Thereby, the bath rapidly becomes useless.

If, for comparison with examples 11 to 13, coordinatively acting solvents for the catalyst or the rinsing baths are used, the boundary surface-activity of the catalyst is lost and no activation or aluminizing of the substrate is obtained.

EXAMPLE 14

In the same manner as in Example 11, a beryllium oxide wafer is immersed in a $1 \times 10^{-4}$ m catalyst solution of ethyl titanate stearate in hexane and is subsequently rinsed with the same solvent. Aluminum then precipitates uniformly on the substrate surface in the aluminizing bath. The silver-bright and dull aluminum layer can be reinforced without further pretreatment by electroplating with aluminum.

What is claimed is:

1. A method for the currentless catalytic precipitation of aluminum from aprotic alane complex baths on surfaces of insulating on conductive substrate materials, said process comprising the steps of:

(a) contacting said substrate with a dilute solution of a boundary surface active catalyst to activate the surface of said substrate;

(b) thereafter intensively washing the substrate in an aprotic solvent; and (c) immersing said substrate in an aluminizing bath comprised of an organic solution of trialkylaminalane.

2. A method according to claim 1 wherein said aluminizing bath comprises a solution of trialkylaminalane in a solvent mixture of aromatic and high-viscosity aliphatic compounds.

3. A method according to claim 1 wherein said aluminizing bath contains from about 0.2 to about 10% of trialkylaminalane by weight.

4. A method according to claim 3 wherein said boundary surface active catalyst comprises a dilute solution of a modified ester or acylate of a metal selected from the group consisting of titanium, zirconium and vanadium wherein one atom of said metal contains a substituent selected from the group consisting of short-chain and long-chain organic radicals.

5. A method according to claim 4 wherein the boundary surface active catalyst is dissolved in a non-polar solvent.

6. A method according to claim 5 wherein said non-polar solvent is an aliphatic hydrocarbon containing 5 to 15 carbon atoms.

7. A method according to claim 3 wherein said boundary surface active catalyst comprises a solution of a chloride of a transition metal of the IV and V secondary group of the periodic system of the elements and a water-containing metal soap of a polyvalent metal.

8. A method according to claim 7 wherein said boundary surface active catalyst is dissolved in a non-polar solvent.

9. A method according to claim 7 wherein said transition metal chloride is titanium tetrachloride.

10. A method according to claim 7 wherein said water-containing metal soap is an aluminum soap.

11. A method according to claim 3 wherein the aprotic solvent in which the activated substrate is washed comprises an aprotic solvent having a boiling point above about 100° C.

12. A method according to claim 4 wherein said boundary surface active catalyst comprises an aliphatic solution of from about $1 \times 10^{-4}$ to about 2% by weight of a member selected from the group consisting of a mixed ester, acylate and partially acylated ester of said metals.

13. A method according to claim 7 wherein said boundary surface active catalyst comprises an ether solution of said transition metal chloride and said metal soap in the ratio of from about 2000:1 to about 200:1.

14. A method according to claim 13 wherein said metal soap contains from about $1 \times 10^{-6}$ to about 3% water by weight.

15. A method according to claim 11 wherein said aprotic solvent is an aliphatic compound.

16. A method according to claim 3 wherein said aluminizing bath comprises a solution of from about 1 to 4% by weight trialkylaminalane in a 4:1 to 3:7 volume mixture of paraffin oil and toluene.

17. A method according to claim 1 wherein said substrate is an electronic component.

18. A method for the currentless catalytic precipitation of aluminum from aprotic alane complex baths on surfaces of insulating or conductive substrate materials, said process comprising the steps of:

(a) contacting said substrate with a dilute solution of a boundary surface-active catalyst selected from the group consisting of:

1. a modified ester or acylate of a metal selected from the group consisting of titanium, zirconium and vanadium wherein one atom of said metal contains a substituent selected from the group consisting of short-chain and long-chain organic radicals; and 2. a chloride of a transition metal of the IV and V secondary group of the periodic system of elements and a water-containing metal soap of a polyvalent metal;

(b) thereafter intensively washing the substrate in an aprotic solvent; and (c) immersing said substrate in an aluminizing bath comprised of an organic solution of trialkylaminalane.

19. A method for the currentless catalytic precipitation of aluminum from aprotic alane complex baths on surfaces of insulating or conducting substrate materials, said process comprising the steps of:

(a) contacting said substrate with a dilute solution of a boundary surface active catalyst to activate the surface of said substrate, said catalyst comprising a halogen-free modifed ester or acylate of a metal selected from the group consisting of titanium, zirconium and vanadium wherein one atom of said metal contains a substituent selected from the group consisting of short-chain and long-chain organic radicals;

(b) thereafter intensively washing the substrate in an aprotic solvent; and (c) immersing said substrate in an aluminizing bath comprised of an organic solution trialkylaminalane.

* * * * *